US005553375A

United States Patent [19]

Powers

[11] Patent Number: 5,553,375

[45] Date of Patent: Sep. 10, 1996

[54] APPARATUS FOR MANUFACTURING TRUSSES AND ASSOCIATED METHOD

[75] Inventor: Frederick P. Powers, Edenton, N.C.

[73] Assignee: Tee-Lok Corporation, Edenton, N.C.

[21] Appl. No.: 309,810

[22] Filed: Sep. 21, 1994

[51] Int. Cl.[6] ..... B30B 15/16; B30B 3/02

[52] U.S. Cl. ..... 29/798; 100/210; 100/913

[58] Field of Search ..... 29/798; 100/913, 100/210, 156

[56] References Cited

U.S. PATENT DOCUMENTS

| | | | |
|---|---|---|---|
| 3,464,348 | 9/1969 | McGlinchey | 100/210 |
| 3,538,843 | 11/1970 | Lubin | 100/210 X |
| 3,855,917 | 12/1974 | Farrell et al. | 100/210 X |
| 4,437,234 | 3/1984 | Thornton | 29/798 |
| 5,211,108 | 5/1993 | Gore et al. | 100/913 X |
| 5,249,352 | 10/1993 | Landers | 29/798 X |

*Primary Examiner*—Joseph M. Gorski
*Attorney, Agent, or Firm*—Bell, Seltzer, Park & Gibson, P.A.

[57] ABSTRACT

An apparatus for manufacturing trusses is provided for pressing truss plates into a plurality of wood pieces positioned on a platform and for facilitating easy removal of the truss from the platform. The apparatus includes a pair of guide tracks extending along the platform and having separate end portions adjacent the removal end of the platform. A gantry frame is supported on the guide tracks and carries a roller above the platform for pressing the truss plates into the wood pieces. The apparatus includes lifting means for lifting the end portions of the guide tracks and the gantry frame supported thereon. Accordingly, the truss can be easily removed from the platform by passing it under the roller. In addition, wheels are disclosed for facilitating movement of the apparatus away from the platform to allow maintenance thereof. An associated method of manufacturing trusses is also disclosed.

26 Claims, 7 Drawing Sheets

APPARATUS FOR MANUFACTURING TRUSSES AND ASSOCIATED METHOD

FIELD OF THE INVENTION

The present invention relates to an apparatus for use in the manufacture of trusses, and more particularly, to an apparatus for facilitating the removal of a truss from the apparatus.

BACKGROUND OF THE INVENTION

Pre-manufactured trusses are often used in the construction of modern structures. Roof trusses and floor trusses, for example, can be manufactured to the correct specifications at a factory and then shipped to the construction site. Because they are pre-manufactured, the trusses can be installed quickly and easily. Moreover, the trusses can be engineered at the factory to provide the necessary strength with a minimal amount of material.

Each truss comprises a collection of wood pieces held together by truss plates embedded in the wood at the intersections of the pieces. A truss plate comprises a square or rectangular piece of metal sheet having a plurality of projections extending from one side thereof and is pressed into an intersection of two or more wood pieces so that a substantial number of the projections of the truss plate are pressed into each of the wood pieces. Precise alignment of the truss plates is necessary; however, with this type of apparatus the wood pieces can be joined together quickly and easily to thereby form a strong truss.

A gantry press is often used to help automate the manufacture of these trusses by pressing the truss plates into the wood pieces. The various wood pieces are first cut and then positioned on a platform in the desired configuration. The truss plates are placed in the appropriate positions on top of and beneath the intersections of the wood pieces and the gantry press is then rolled over the partially completed truss to press all of the truss plates into the wood. The gantry press typically presses the truss plates into the wood pieces to a depth of 50–80% of the total length of the projections. Accordingly, the truss may then be passed through a final press, which comprises a pair of nip rollers, to firmly embed the truss plates in the wood pieces.

The typical gantry press includes a movable gantry frame mounted on two guide tracks extending along each side of the platform. A roller is carried by the gantry frame at a predetermined distance above the platform surface so that, as the gantry frame is moved along the guide tracks, the roller presses the truss plates into the wood pieces.

In truss manufacturing it is desirable to remove the truss from a desired end of the platform once the truss plates have been pressed. After the gantry frame has traveled along the length of the platform, it is parked at one end and the truss may be removed from an opposite end. However, the vertical position of the roller relative to the platform prevents the truss from being removed from the end of the platform where the gantry frame is parked. Accordingly, to allow all of the trusses to be removed from the desired end of the platform, one approach is to make two passes with the gantry frame, which slows production. The truss cannot be removed from the table, and the assembly of another truss begun, until the return pass has been completed.

Several approaches have attempted to solve this problem by providing a truss manufacturing apparatus where only one pass of the gantry frame is required for each truss. One approach incorporates guide tracks which are inclined beyond the desired end of the platform. Thus, as the gantry frame is moved beyond the end of the platform it is also raised so that the completed truss may be passed under the roller for removal. This approach, however, requires guide tracks which extend substantially past the end of the platform to provide the necessary amount of incline and thus is disadvantageous in manufacturing facilities where floor space is limited.

A second approach incorporates a lifting device for raising the roller from its supports in the gantry frame so that the completed truss can be removed by being passed under the roller. This approach, however, may not sufficiently maintain the predetermined distance between the bottom of the roller and platform, which is important for proper truss formation. Each raising and lowering operation may cause the roller to be misaligned relative to the gantry frame and therefore also misaligned relative to the platform. Accordingly, the truss plates may not be properly pressed into the wood, which can be detrimental to the trusses.

In addition, it is desirable with gantry presses to perform periodic maintenance such as lubrication of the various moving parts or resurfacing or replacement of the gantry roller. However, with conventional gantry presses it is difficult to obtain access to the gantry frame and roller because of their proximity to the platform. Moreover, conventional gantry presses are fixed in position relative to the platform so that the production of trusses must be halted while the maintenance is performed.

SUMMARY OF THE INVENTION

It is therefore an object of the present invention to provide an apparatus and method for use in the manufacture of trusses wherein only one pass of the gantry frame is required for each truss that is manufactured.

It is another object of the present invention to provide an apparatus and method for use in the manufacture of trusses which requires only a minimal amount of floor space.

It is yet another object of the present invention to provide an apparatus and method for use in the manufacture of trusses wherein the predetermined distance between the bottom of the roller and the platform is maintained constant for each pass of the roller.

It is still another object of the present invention to provide an apparatus and method for use in the manufacture of trusses which can be easily removed from adjacent the platform to allow periodic maintenance.

The above and other objects and advantages of the present invention are provided by an apparatus for pressing truss plates into a plurality of prepositioned wood pieces including lifting means for lifting end portions of guide tracks supporting the gantry frame so that a completed truss can be passed under the roller. The apparatus includes a platform for supporting the truss during positioning of the wood pieces and pressing of the truss plates.

A pair of guide tracks extend between the ends of the platform and the guide tracks have end portions adjacent the desired end of the platform. A gantry frame is supported on the guide tracks for back and forth movement along the platform and carries a roller above the platform for pressing the truss plates into the wood pieces as the gantry frame passes along the platform. The apparatus may also include a final press having a pair of opposing nip rollers located downstream from the lifting means for pressing the truss plates further into the truss.

The lifting means of the apparatus lifts the end portions of the guide tracks and the gantry frame supported thereon. Accordingly, removal of a truss from the desired end of the platform is facilitated because the roller can be raised relative to the platform and the truss can then be passed under the roller. The lifting means includes an actuator which may comprise at least one inflatable bag disposed under the gantry frame.

The lifting means may further include a lift frame which has a plurality of guide track supports for supporting the end portions of the guide tracks. The lift frame is lifted so that the guide tracks and gantry frame are also lifted. The actuator may comprise at least one inflatable bag disposed beneath the lift frame. The lift frame may further include a pair of conveyor rolls for conveying the truss during removal of the truss from the end of the platform.

The apparatus may further include guide means operatively connected to the lift frame for guiding the lift frame during vertical movement thereof. The guide means includes a guide frame and a pair of stabilizer shafts rotatably mounted thereon. A pair of mating pinion gears are mounted on respective ends of the pair of stabilizer shafts and respective rack gears are mounted on the lift frame and cooperate with each pinion gear in each of the pairs of mating pinion gears.

The apparatus may also include a plurality of wheels removably mounted to the lift frame for facilitating removal of the lifting means from the platform to facilitate maintenance thereof.

The pair of guide tracks may include a first track section extending alongside the platform and secured in fixed relation thereto. The respective end portion comprises a second track section positioned in end-to-end relation with the first track section when the second track section is in a lowered positioned.

An associated method for manufacturing a truss on a platform also comprises an aspect of the present invention. The method includes the steps of moving a gantry frame along the platform so that a roller rotatably mounted on the gantry frame presses truss plates into prepositioned wood pieces on the platform to form the truss; and, moving the gantry frame from a lowered position to an elevated position generally vertically aligned with the lowered position to thereby lift the roller to facilitate removal of the truss from an end of the platform by passing the truss under the roller.

The step of moving the gantry frame from a lowered position to an elevated position may include inflating at least one inflatable bag under the gantry frame. The step of moving the gantry frame from a lowered position to an elevated position further comprises guiding the gantry frame against at least one vertical guide rail.

A method of moving a lifting device for a gantry roller press as used in the manufacture of trusses, wherein the lifting device is of the type including a lift frame and an actuator operatively connected between the lift frame and a fixed mounting for lifting the lift frame, is also disclosed. The method includes the steps of operating the actuator to lift the lift frame from a lowered position to an elevated position and then connecting a plurality of wheels to the lift frame while in the elevated position. The method further includes the step of operating the actuator to lower the lift frame until the lift frame is supported on the plurality of wheels to facilitate moving of the lift frame. The method may also include the steps of disconnecting the actuator from the fixed mounting and securing the actuator to the lift frame so that the actuator can be moved with the lifting device. The actuator operating steps may include inflating or deflating at least one inflatable bag.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate a preferred and exemplary embodiment, and wherein.

DETAILED DESCRIPTION OF A PREFERRED EMBODIMENT

The present invention will now be described more fully hereinafter with reference to the accompanying drawings, in which a preferred embodiment of the invention is shown. This invention may, however, be embodied in many different forms and should not be construed as limited to the embodiment set forth herein; rather, this embodiment is provided so that this disclosure will be thorough and complete and will fully convey the scope of the invention to those skilled in the art. Like numbers refer to like elements throughout.

Figure 1:
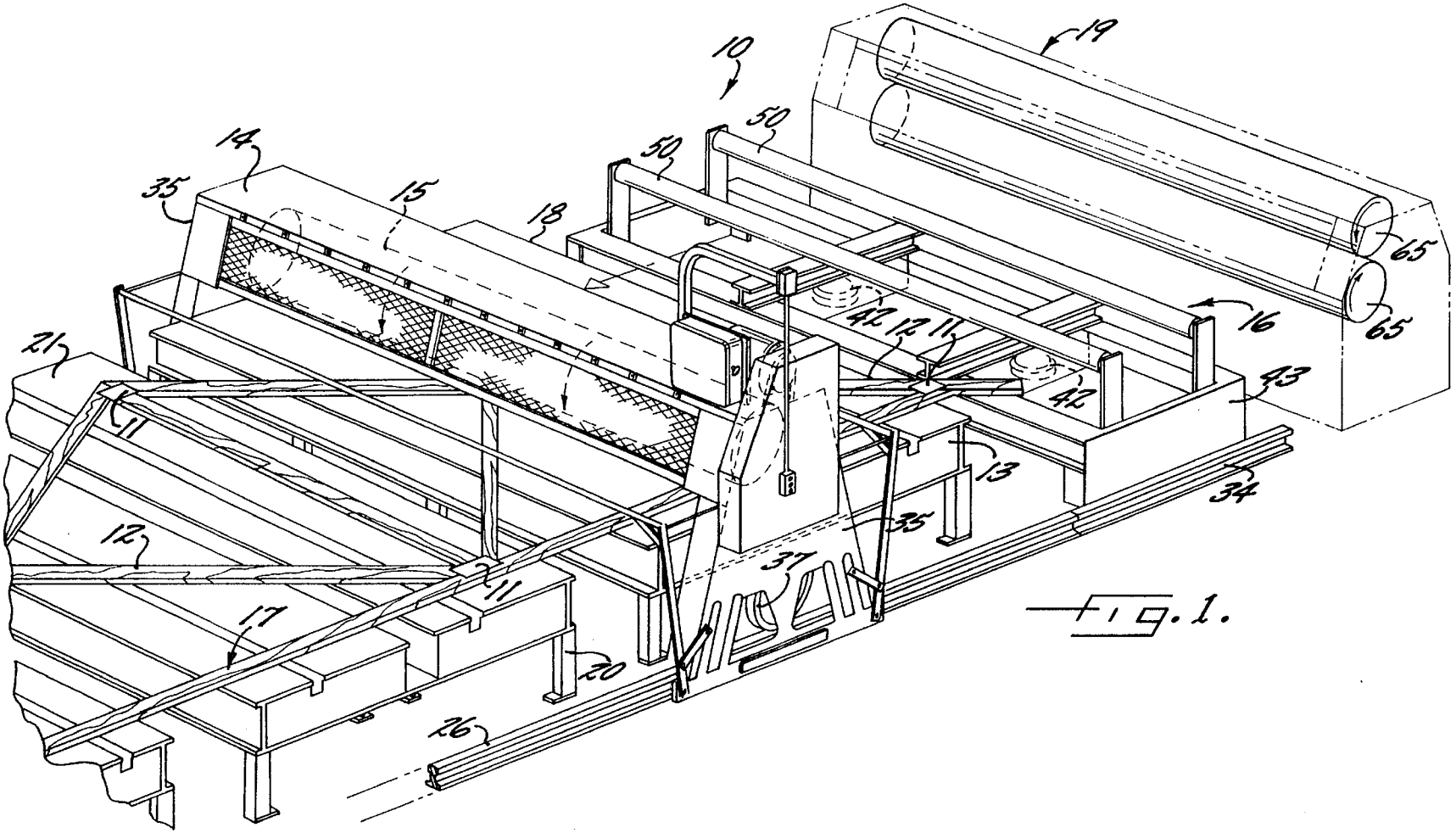
FIG. 1 is a perspective view of the present invention illustrating truss plates being pressed on the platform.
Figure 2:
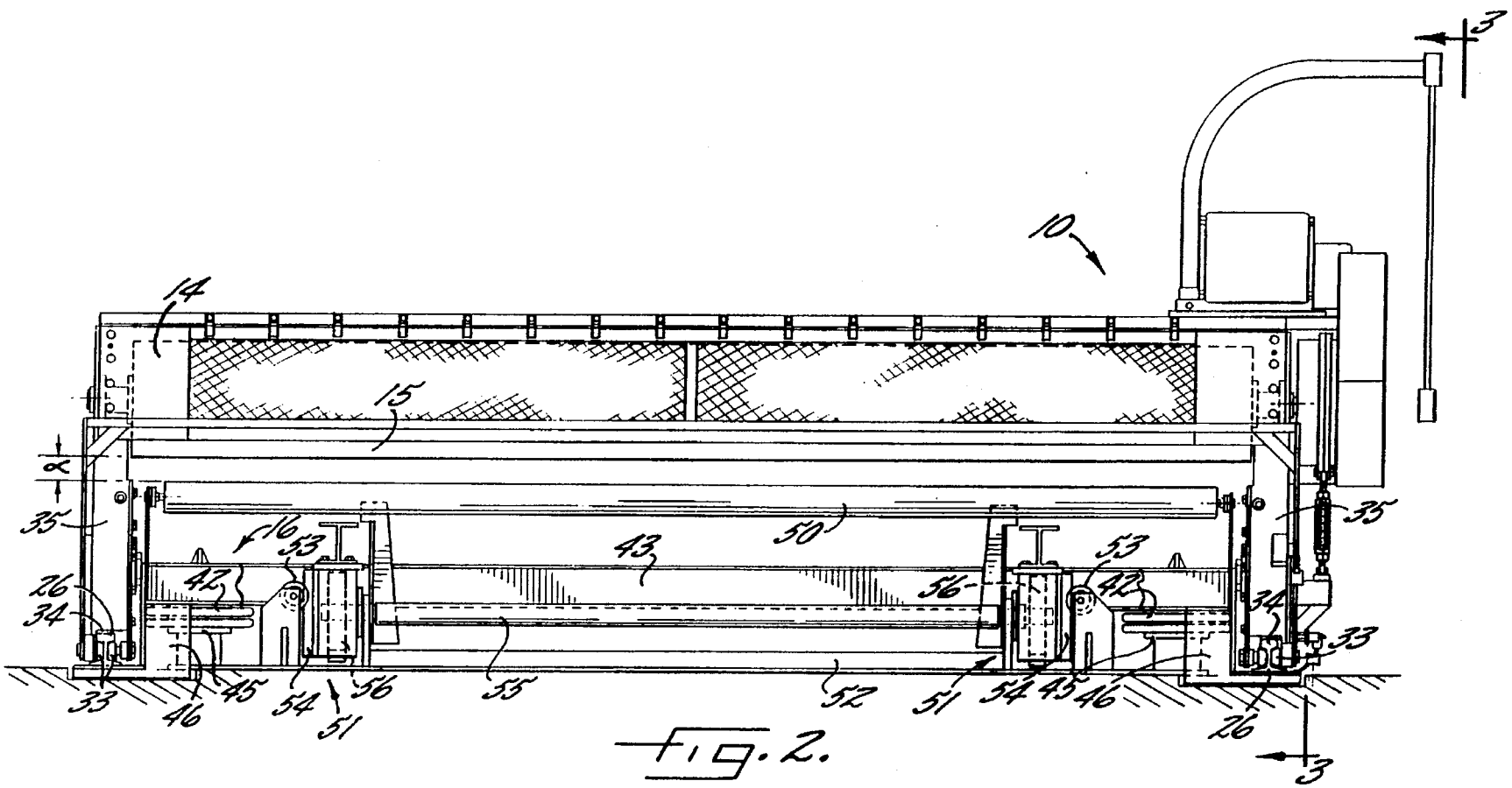
FIG. 2 is a front elevational view of the roller and gantry frame as viewed from the truss platform.

The apparatus 10 of the present invention for pressing truss plates 11 into prepositioned wood pieces 12 is shown in FIG. 1. The apparatus 10 includes a platform 13 upon which a plurality of wood pieces 12 are positioned and a gantry frame 14 carrying a roller 15 which is supported for movement along the platform so that the truss plates will be pressed into the wood pieces. After the gantry frame 14 has traveled the length of the platform 13, lifting means 16 lifts the gantry frame so that the truss 17 can be passed under the roller 15.

The platform 13 is generally rectangular and is of sufficient size to accommodate the outline of most trusses 17. A truss 17 could be removed from either side of the platform 13 once it has been pressed although it is preferable in the truss manufacturing industry to remove completed trusses from a desired end 18 of the platform. Accordingly, the transport of completed trusses can be more readily automated by providing an automatic conveying means (not shown) at the desired end 18 of the platform 13 for conveying the truss 17 to a final press 19.

The platform 13 includes a plurality of legs 20 and a supporting surface 21 mounted thereon. The legs 20 must be of a sufficient size and number and the surface 21 must be formed of a strong material of sufficient thickness to the withstand the compressive forces exerted by the roller 15. These forces can be quite high because the roller 15 may be simultaneously pressing several truss plates 11 into multiple pieces of wood 12. Specifically, the supporting surface 21 should not undergo any appreciable deflection when the roller 15 is passed over the truss 17 so that the truss plates 11 will be embedded in the wood pieces 12 to the correct depth.

Figures 3, 4:
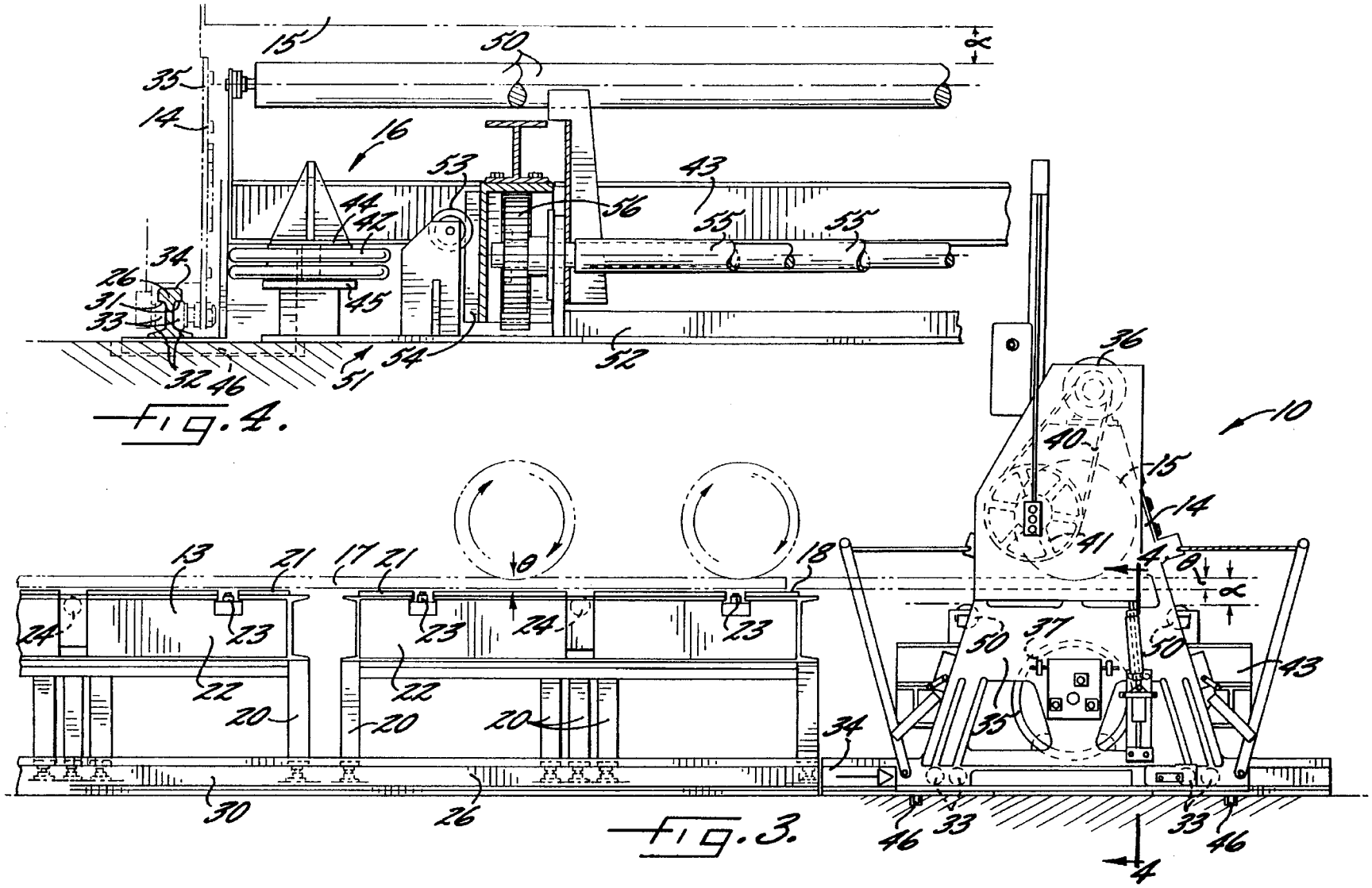
FIG. 3 is a side elevational view of the platform and gantry frame of the present invention as viewed from line 3—3 of FIG. 2.
FIG. 4 is an enlarged sectional view of the present invention taken along line 4—4 of FIG. 3 and illustrating the lift frame and inflatable bag in a deflated condition.

The platform 13 may be made up of a number of sections 22 which are separated from each other by a small gap, as shown in FIG. 3, to allow workers full access to the platform for positioning the wood pieces 12 and for placing the truss plates 11 at the intersections of the wood pieces. The sections 22 are arranged so that no wood piece intersections are disposed over any gaps so as to ensure sufficient backing support during the rolling operation.

The platform 13 may also include a number of jig holders 23 under the supporting surface 21. The jig holders 23 support various jigs (not shown) which provide a vertical surface against which individual wood pieces 12 are placed so that the workers can quickly position the necessary wood pieces 12 to create the desired truss 17. As would be appreciated by one of ordinary skill in the art, different jig patterns can be arranged to form different trusses.

The wood pieces 12 used in the manufacture of trusses are often rectangular in cross-section and may comprise, for example, lengths of 2×4 studs. With respect to roof trusses, the long axis of the wood pieces 12 extends in a vertical plane when installed. Accordingly, the wood pieces 12 are placed horizontally on the platform 13 as shown in FIG. 1. With respect to floor trusses, the short axis is disposed in a vertical plane when installed and, accordingly, the wood pieces 12 are arranged vertically on the platform 13, i.e., with their long axes extending vertically.

Figures 5, 6:
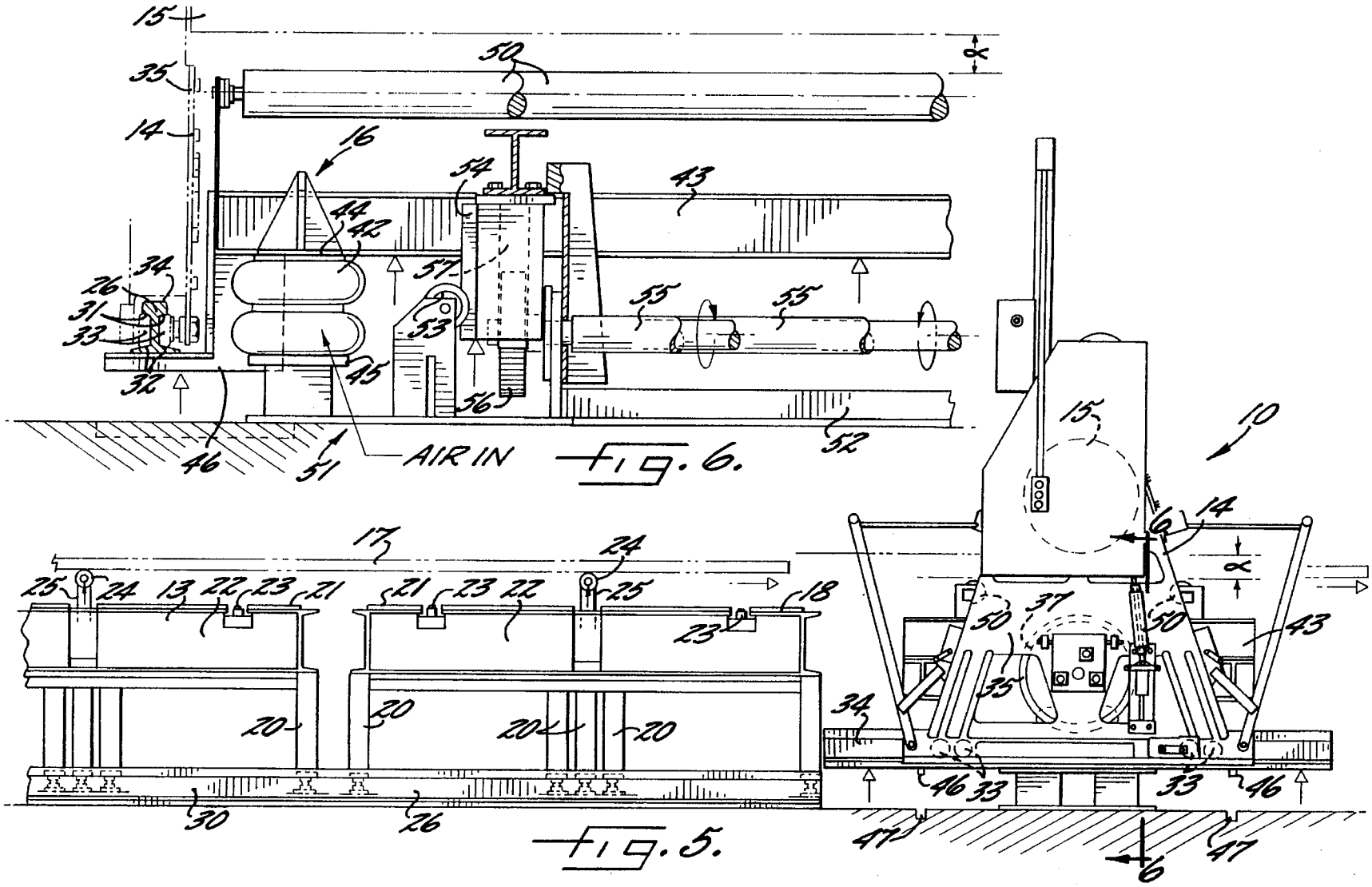
FIG. 5 is a similar view to FIG. 3 but shows the gantry frame and guide track in the elevated position.
FIG. 6 is a similar view to FIG. 4 but illustrates the inflatable bag in an inflated condition.

The platform 13 may also include a number of conveyor rolls 24 individually mounted on upwardly movable frames 25. The frames 25 and conveyor rolls 24 are oriented transversely to the long axis of the platform 13 and are normally disposed beneath the surface 21 of the platform during the positioning of the wood pieces 12 and the pressing of the truss plates 11 by the roller 15, as shown in FIG. 3. After the rolling is completed, the frames 25 are moved upwardly, by means of pneumatic or hydraulic cylinders (not shown), for example, so that the conveyor rolls 24 are positioned above the platform surface 31, as shown in FIG. 5. Accordingly, the trusses 17 may be more easily removed from the platform 13 by rolling the trusses over the conveyor rolls 24.

Figure 15:
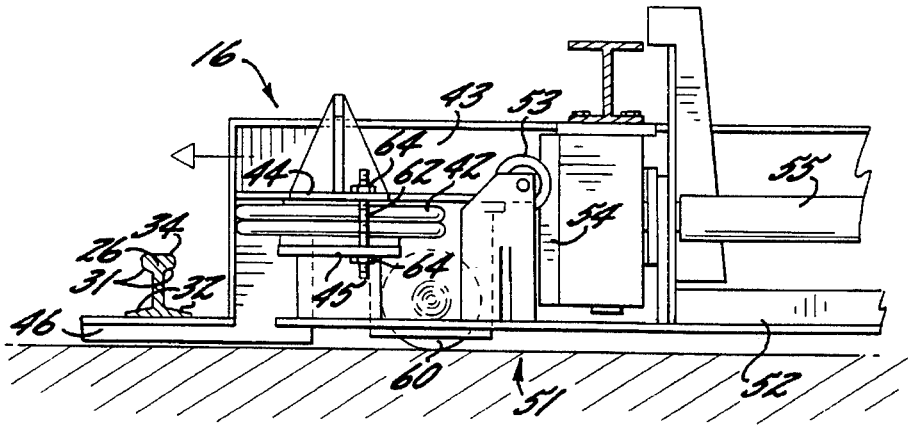

A pair of guide tracks 26 extend along the length of the platform 13 between the desired 18 and opposing ends, a first section 30 of which may be secured to the floor. The tracks 26 are formed of any material of suitable strength and, as best shown in FIG. 15, have upper 31 and lower 32 generally horizontal surfaces. The gantry frame 14 is supported on wheels 33 which contact both the upper 31 and lower 32 surfaces so that, in addition to supporting the weight of the gantry frame and roller 15 in the downward direction, the wheels resist movement of the gantry frame in the upward direction by forces which may be caused, for example, by the compression of the truss plates 11. Accordingly, a predetermined distance 8 between the roller 15 and the platform 13 can be maintained which is important for proper truss 17 formation.

Each of the guide tracks 26 has an end portion 34, which may comprise a second track section, which extends beyond the desired removal end 18 of the platform 13. The end portion 34 is not secured to the floor and is not physically connected to the remainder of track 30. The end portion 34 can thus be separated from the remainder of the track 30 when moved to a raised position, as best shown in FIG. 5. However, when in the lowered position, the end portions 34 are positioned in end-to-end relation with the remainder of the track 30 so that the gantry frame 14 can be moved to and from the end portions without interruption, as shown in FIG. 4. The end portions 34 do not extend significantly beyond the end of the platform 13 and, accordingly, as discussed above, minimal floor space is required.

The gantry frame 14 is supported on the guide tracks 26 and includes two generally upright end supports 35 disposed over each guide track. The end supports 35 are preferably made of cast iron so that when the roller 15 is installed it will be precisely aligned relative to the platform 13, however, the end supports 35 may also be formed of a welded steel construction. Each of the end supports 35 includes two sets of wheels 33, of the type discussed above, so that the gantry frame 14 is securely supported on the guide tracks 26.

The gantry frame 14 includes an electric motor 36 for driving the gantry frame and roller 15 along the platform 13. The electric motor is operatively 36 connected to a drive wheel 37 by means of chain or similar device (not shown) for moving the gantry frame 14 when the roller is not positioned over a truss 17. The drive wheel 37 is mounted on the gantry frame 14 so that it is in frictional engagement with the top of one of the guide tracks 26 and can thereby propel the gantry frame.

The electric motor 36 is also operatively connected to the roller 15 by means of a belt 40 and sheave 41 for moving the gantry frame when the roller is positioned over a truss 17. The frictional engagement of the roller 15 and the truss 17 thus provides sufficient traction for moving the gantry frame 14. In addition, the upward forces exerted on the roller 15 are sufficient to move the gantry frame 14 slightly upward so that the drive wheel 37 is disengaged from the guide track 26. Accordingly, the roller 15 and drive wheel 37 are geared to the electric motor 36 to propel the gantry frame 14 at approximately the same speed, however, only one of them propels the gantry frame at any given position.

The roller 15 is a large steel or iron roller of sufficient rigidity to apply the necessary compressive force without significant flexing. The roller 15 is supported at either end by bearings (not shown) which are fixedly mounted to the end supports 24 and which are positioned so that the roller is suspended at the predetermined distance θ above the platform 13 to press the truss plates 11 into the wood pieces 12 to the desired depth. As discussed above, this predetermined distance θ is maintained throughout the range of travel of the gantry 14 frame so that all truss plates 11 are pressed to the same degree.

The invention further includes a lifting device or lifting means 16 for lifting the end portions 34 of the guide tracks 26 and the gantry frame 14 supported thereon, as shown in FIGS. 3–6. Accordingly, removal of a truss 17 from the desired end 18 of the platform 13 is facilitated because the roller 15 can be raised relative to the platform and the truss 17 can then be passed under the roller. In contrast to the approach discussed above, however, the roller 15 is maintained in the same spatial relationship relative to guide tracks 26 so that, when lowered, the roller is disposed at the same distance θ relative to the platform as before the lifting operation.

The lifting means 16 includes actuator means which, as shown, may comprise two inflatable bags 42 which are connected to a compressed air source and which are positioned beneath the gantry frame 14. Compressed air is supplied to the inflatable bags 42 to lift the gantry frame 14, as shown in FIG. 6, and released to lower the gantry frame, as shown in FIG. 4. As would be readily apparent to one of ordinary skill in the art, actuator means may comprise any suitable equivalent capable of selectively applying linear force, such as hydraulic or pneumatic cylinders or a rotary motor coupled to a suitable linear force generating mechanism.

The lifting means 16 may further include a lift frame 43 positioned beneath the gantry frame 14. The inflatable bags 42 are positioned between upper 44 and lower 45 support pads operatively connected to the lift frame 43 and the floor, respectively. The lift frame 43 includes a plurality of guide track supports 46 for supporting the end portions 34 of the guide tracks 26. The guide track supports 46 are generally "L"-shaped brackets which extend beneath the end portions 34 of the guide tracks 26, and, when the gantry frame 14 is in the lowered position, lie in a recess 47 formed in the floor. Accordingly, when the inflatable bags 42 are inflated, the lift frame 43 and guide track supports 46 are lifted which in turn lift the end portions 34 of the tracks 26 and the gantry frame 14 and roller 15 supported thereon.

Alternately, it would be readily appreciated by one of ordinary skill in the art that the actuator means could act directly on the gantry frame 14. In such a configuration, the end portions 34 of the guide tracks 26 may be lifted by the gantry frame wheels 33 exerting force on the upper horizontal surfaces 31 of the guide tracks.

The lift frame 43 may further comprise a pair of conveyor rolls 50 for conveying the truss 17 during removal of the truss from the desired removal end 18 of the platform 13. The conveyor rolls 50 on the lift frame 43 are mounted so that, when the lift frame 43 is in the elevated position, the elevation of the rolls is substantially the same as the elevation of the conveyor rolls 24 of the platform 13 when they are in the elevated position. Accordingly, when a truss 17 is removed from the platform 13, it can be easily conveyed from the platform conveyor rolls 24 to the lift frame conveyor rolls 50 in substantially the same plane. In addition, the conveyor rolls 50 of the lift frame 43 are mounted at a distance αbelow the roller 15 which is large enough to allow the trusses 17 to be passed therebetween. The lift frame 43, which is positioned at the desired removal end 18 of the platform 13, may also be lifted when the gantry frame 14 is parked at the opposite end to raise the conveyor rolls 50 to the desired elevation as further discussed below.

The apparatus 10 may further include guide means 51 for guiding the lift frame 43 during lifting. The guide means 51 may include a guide frame 52 is mounted in a fixed relationship to the platform 13 to ensure that the roller 15 is disposed in the proper position after the gantry frame 14 has been lowered. Accordingly, the guide frame 52 may be fixed to the floor adjacent to the desired end 18 of the platform 13 or may be fixed to the platform itself.

Figure 9:
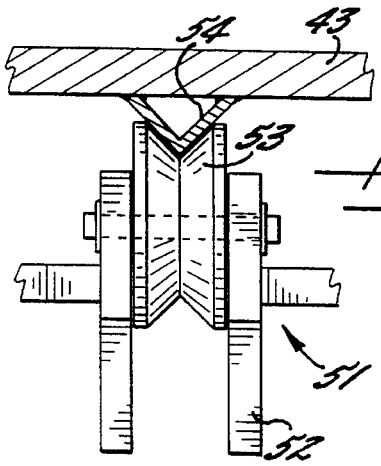
FIG. 9 is an enlarged top sectional view of the lift frame and guide frame of the present invention.
Figure 10:
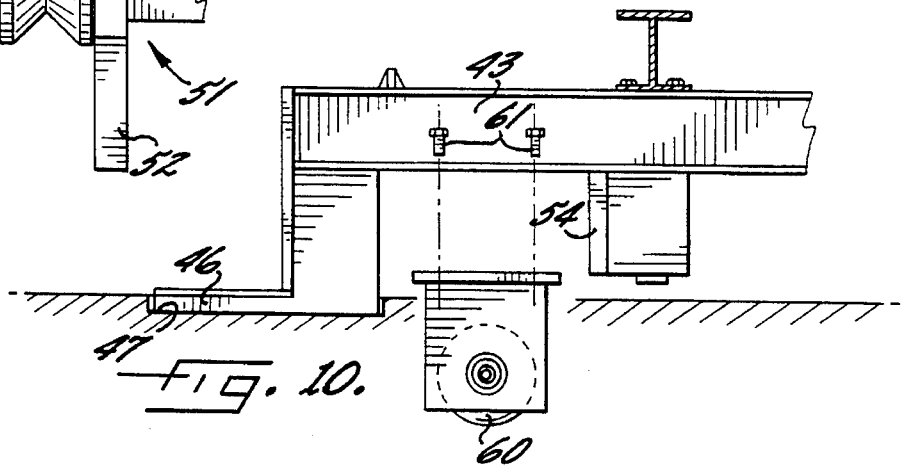
FIG. 10 is a partially sectional view of the lift frame of the present invention illustrating the maintenance wheels prior to being installed.

The guide frame 52 includes a pair of guide wheels 53 at either end which act in cooperation with a pair of corresponding guide rails 54 mounted on the lift frame. The outer peripheries of the guide wheels 53 have a concave "V"-shaped contour which correspond to the contours of the guide rails 54, as is best shown in FIG. 9. The lift frame 43 is thus guided so as to be raised relative to the guide frame 52 in a substantially vertical direction. In addition, the lower support pads 45 for the inflatable bags 42 may be mounted on the guide frame 52.

Figure 7:
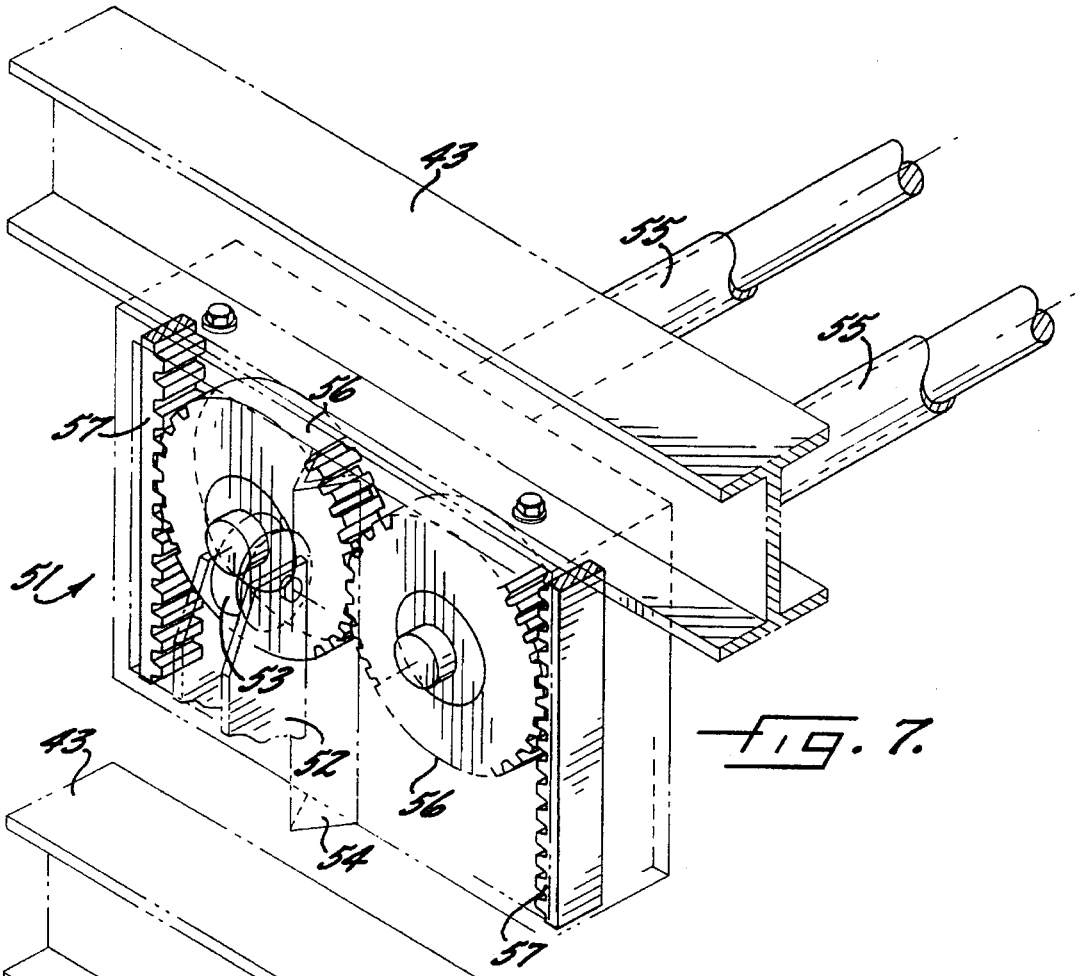
FIG. 7 is a greatly enlarged partially sectional view of the lift frame and guide means of the present invention.
Figure 8:
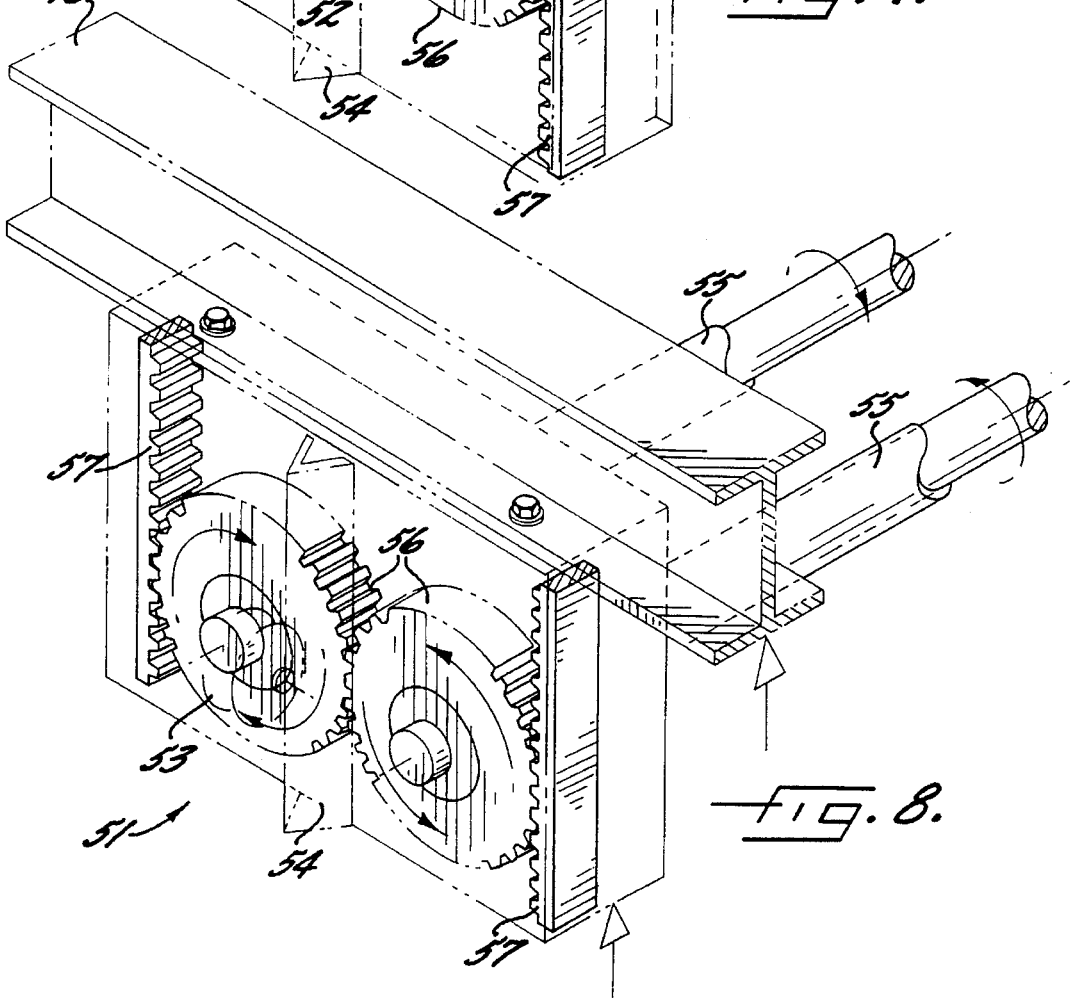
FIG. 8 is a similar view to FIG. 7 illustrating the lift frame in the elevated position.

The guide means 51 also includes a pair of parallel and rotatably mounted stabilizer shafts 55 for ensuring that both ends of the gantry frame 14 are lifted the same amount. A pinion gear 56 is mounted to either end of both shafts 55 and each pinion gear is supported in a mating relationship with a corresponding rack gear 57 mounted to the underside of the lift frame 43, as shown in FIG. 7. In addition, the two pinion gears 56 at the same end of the respective shafts 55 are held in a mating relationship. Accordingly, as the lift frame 43 is raised and lowered, the shafts 55 rotate in opposite directions, as shown in FIG. 8.

The lift frame 43 is thus fixed at four points relative to the guide frame 52 to ensure that the gantry frame 14 remains in a horizontal plane relative to the platform 13 as the gantry frame is lifted. The pinion gears 56 on either end of one of the shafts 55 ensure that corresponding ends of the lift frame 43 are always disposed at the same elevation. Similarly, the mating gears 56 at the same end of both shafts 55 ensure that the corresponding rack gears 57 are always disposed at the same elevation. Accordingly, if the inflatable bags 42 do not inflate or deflate at exactly the same rate, the gantry frame 14 will nevertheless be raised so as to always be maintained in a plane parallel to the platform 13. As discussed above, it is desirable in the manufacture of trusses 17 to maintain the roller 15 in a constant orientation relative to the platform 13 to ensure consistent and precise truss formation.

Another aspect of the invention is a plurality of maintenance wheels 60 which can be removably connected to the underside of the lift frame 43 with bolts 61, as shown in FIGS. 10–15. As discussed above, it is desirable to periodically remove the gantry 14 frame from adjacent the platform 13 to allow maintenance thereof. The maintenance wheels 60, when mounted, allow the entire gantry press assembly, including the gantry frame 14, lift frame 43, inflatable bags 42 and guide frame 52, to be wheeled away from the platform 13. A second gantry press may then be easily wheeled into place to minimize downtime of the platform 13.

Figure 11:
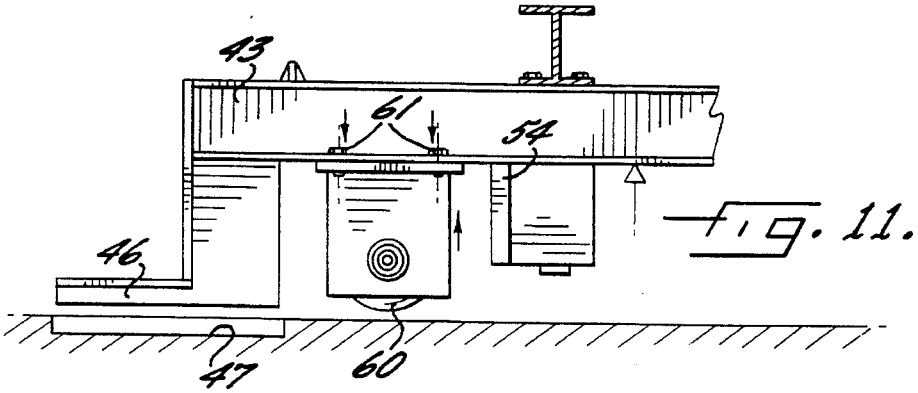
FIG. 11 is a similar view to FIG. 10 illustrating the maintenance wheels installed and the lift frame in the elevated position.
Figure 12:
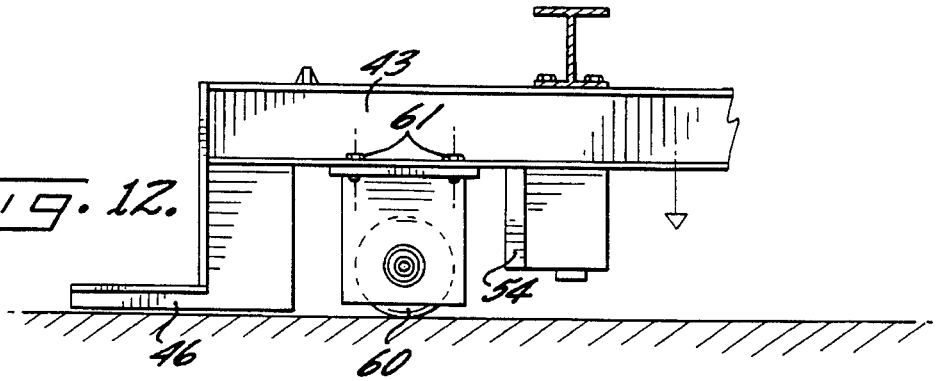
FIG. 12 is a similar view as FIG. 11 illustrating the maintenance wheels supported on the floor.

To remove the gantry press assembly from the platform 13, the inflatable bags 42 are inflated and the lift frame 43 is raised a sufficient amount to allow installation of the four maintenance wheels 60 adjacent the corners of the lift frame, as shown in FIG. 11. The lift frame 43 is then lowered so that the lift frame 43, gantry frame 14 and roller 15 are supported by the wheels 60 resting on the floor, as shown in FIG. 12.

Figure 13:
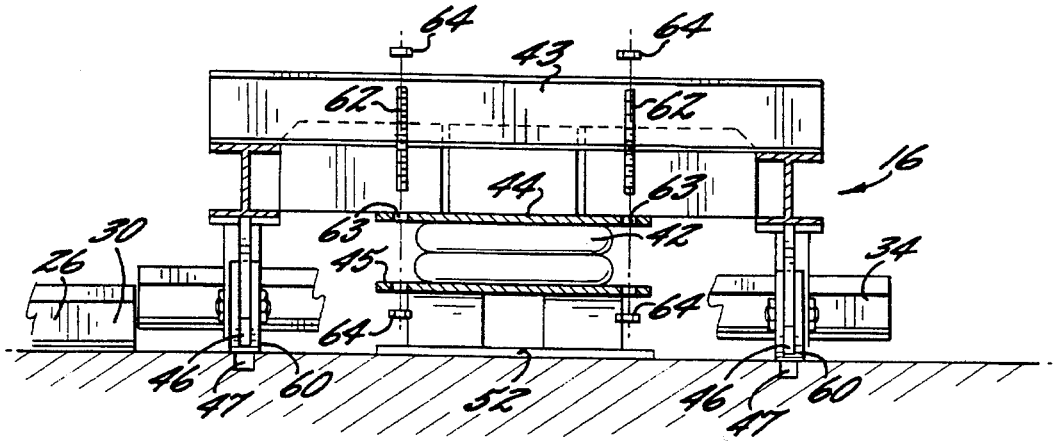
FIG. 13 is a partially sectional view of the lift frame of the present invention showing the bolts prior to being installed in the upper and lower inflatable bag support pads.
Figure 14:
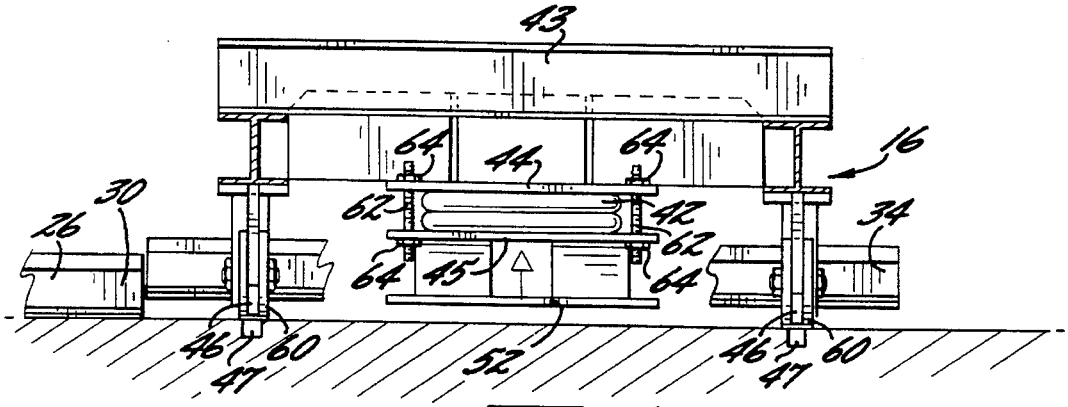
FIG. 14 is a similar view to FIG. 13 illustrating the suspended position of the guide frame; and, FIG. 15 is a partially sectional view of the lift frame and guide frame of the present invention being removed from adjacent the platform.

Bolts 62 are then placed in corresponding holes 63 in the upper 44 and lower 45 inflatable bag support pads, as shown in FIG. 13, and nuts 64 are tightened on the bolts to draw the guide frame 52 against the underside of the lift frame 43. Accordingly, the entire gantry press assembly is supported by the wheels 60 and can be wheeled away from the platform 13, as shown in FIG. 15.

An associated method of manufacturing trusses 17 also forms a part of the invention. The wood pieces 12 are first cut to the desired length and the appropriate angle is cut at the ends of the wood pieces. Workers then position the pieces of wood 12 on the platform 13 against the jigs, as discussed above, to form the desired truss pattern. Truss plates 11 are placed at the intersections of adjoining wood pieces 12 and the plates on top of the truss are then tacked into place by striking the leading edge of the truss plates, i.e., the edge facing the roller 15, with a hammer or mallet.

The gantry frame 14 is then started along the guide tracks 26 from a parked position at the desired end 18 of the platform 13 and passed over the length of the truss 17. The roller 15 presses each of the truss plates 11 into the wood pieces 12 to a depth of approximately 50–80% of the depth when fully embedded.

The gantry frame 14 is parked at the opposite end and the platform conveyor rolls 24 are raised to lift the partially completed truss 17. The inflatable bags 42 are inflated to also lift the conveyor rolls 50 mounted on the lift frame 43 to the same elevation as the platform conveyor rolls 24. The truss 17 is then rolled by workers along the conveyor rolls 24 at the platform 13 and the conveyor rolls 50 of the lift frame 43 until it is fed into the final press 19, which may comprise a pair of opposing nip rollers 65, for fully embedding the truss plates 11.

The conveyor rolls 24, 50 of the platform 13 and lift frame 43 respectively are then returned to their respective lowered positions and placement of the wood pieces 12 and truss plates 11 for a second truss is then begun. The truss plates 11 are now tacked to the wood pieces 12 at the opposite edge facing the new position of the roller 15. The gantry frame 14 is started from the parked position and passed over the platform 13 to press the truss plates 11.

The gantry frame 14 rolls along the guide tracks 26 and onto the end portions 34 of the guide tracks where it is parked. The inflatable bags 42 are again inflated and the lift frame 43 is lifted. The guide track supports 46 engage the end portions 34 of the guide tracks 26 and the gantry frame 14 is thereby lifted. The platform conveyor rolls 24 are also lifted and the partially completed truss 17 is removed from the platform 13 in the same manner as before, except that the truss is now passed under the roller 15. The completed cycle thus allows the manufacture of two trusses with only two passes of the gantry frame 14.

In the drawings and the specification, there has been set forth a preferred embodiment of the invention and, although specific terms are employed, the terms are used in a generic and descriptive sense only and not for purposes of limitation, the scope of the invention being set forth in the following claims.

That which is claimed is:

1. The apparatus for manufacturing a truss by pressing truss plates into prepositioned wood pieces, said apparatus comprising:

a platform for supporting the prepositioned wood pieces;

a pair of guide tracks extending alongside said platform, said pair of guide tracks having respective end portions adjacent an end of said platform and being movable in a generally vertical direction;

a gantry frame supported on said pair of guide tracks for back and forth movement along said platform;

a roller rotatably mounted on said gantry frame for pressing the truss plates into the prepositioned wood pieces as said gantry frame moves along said platform; and lifting means for simultaneously lifting the end portions of said pair of guide tracks, said gantry frame, and said roller relative to said platform to facilitate removal of the truss from the end of said platform by passing the truss under the lifted roller.

2. An apparatus for manufacturing a truss as defined in claim 1 further comprising final press means positioned downstream from said lifting means for pressing the wood pieces plates further into the truss, and wherein said final press means comprises a pair of opposing nip rollers generally aligned with a plane defined by said platform.

3. An apparatus for manufacturing a truss as defined in claim 1 wherein said lifting means comprises:

a lift frame, said lift frame having a plurality of guide track supports for supporting the end portions of said guide tracks; and actuator means for lifting said lift frame so that said guide tracks and said gantry frame are also lifted thereby.

4. An apparatus for manufacturing a truss as defined in claim 3 wherein said actuator means comprises at least one inflatable bag operatively connected to said lift frame.

5. An apparatus for manufacturing a truss as defined in claim 3 further comprising at least one conveyor roll rotatably mounted on said lift frame for conveying the truss during removal thereof.

6. An apparatus for manufacturing a truss as defined in claim 3 wherein said lifting means further comprises guide means operatively connected to said lift frame for guiding same during vertical movement thereof.

7. An apparatus for manufacturing a truss as defined in claim 8 wherein said guide means comprises:

a guide frame;

a pair of stabilizer shafts rotatably mounted on said guide frame;

a pair of mating pinion gears mounted on respective ends of said pair of stabilizer shafts; and respective rack gears mounted on said lift frame and cooperating with each pinion gear in each of said pair of mating pinion gears.

8. An apparatus for manufacturing a truss as defined in claim 3 further comprising a plurality of wheels removably connected to said lift frame for facilitating movement of said lifting means away from said platform.

9. An apparatus for manufacturing a truss as defined in claim 1 wherein said lifting means comprises actuator means for lifting said gantry frame so that said guide tracks are also lifted thereby.

10. An apparatus for manufacturing a truss as defined in claim 9 wherein said actuator means comprises at least one inflatable bag operatively connected to said gantry frame.

11. An apparatus for manufacturing a truss as defined in claim 1 wherein each of said pair of guide tracks comprises a first track section extending alongside said platform and secured in fixed relation thereto, and wherein each respective end portion comprises a second track section positioned in end-to-end relation with the first track section when in a lowered positioned.

12. The apparatus for manufacturing a truss by pressing truss plates into prepositioned wood pieces, said apparatus comprising:

a platform for supporting the prepositioned wood pieces;

a pair of guide tracks extending alongside said platform, each of said pair of guide tracks comprising a first track section extending alongside said platform and secured in fixed relation thereto, and a second track section movable in a generally vertical direction relative to said first track section between a lowered and an elevated position so that the second track section is positioned in end-to-end relation with the first track section when in the lowered positioned;

a gantry frame supported on said pair of guide tracks for back and forth movement along said platform;

a roller rotatably mounted on said gantry frame for pressing the truss plates into the prepositioned wood pieces as said gantry frame moves along said pair of guide tracks; and lifting means for lifting the respective second track sections, said gantry frame, and said roller to facilitate removal of the truss from the end of said platform by passing the truss under the lifted roller, said lifting means further comprising guide means operatively connected to said gantry frame for guiding same during vertical movement thereof.

13. An apparatus for manufacturing a truss as defined in claim 12 further comprising final press means positioned downstream from said lifting means for pressing the truss plates further into the truss, and wherein said final press means comprises a pair of opposing nip rollers generally aligned with a plane defined by said platform.

14. An apparatus for manufacturing a truss as defined in claim 12 wherein said lifting means further comprises:

a lift frame, said lift frame having a plurality of guide track supports for supporting the respective second track sections; and actuator means for lifting said lift frame so that the respective second track sections and said gantry frame are also lifted thereby.

15. An apparatus for manufacturing a truss as defined in claim 14 wherein said actuator means comprises at least one inflatable bag operatively connected to said lift frame.

16. An apparatus for manufacturing a truss as defined in claim 14 further comprising at least one conveyor roll rotatably mounted on said lift frame for conveying the truss during removal thereof.

17. An apparatus for manufacturing a truss as defined in claim 14 further comprising a plurality of wheels removably connected to said lift frame for facilitating movement of said lifting means away from said platform.

18. An apparatus for manufacturing a truss as defined in claim 12 wherein said lifting means further comprises actuator means for lifting said gantry frame so that the respective second track sections are also lifted thereby.

19. An apparatus for manufacturing a truss as defined in claim 18 wherein said actuator means comprises at least one inflatable bag operatively connected to said gantry frame.

20. An apparatus for manufacturing a truss as defined in claim 12 wherein said guide means comprises:

a guide frame;

a pair of stabilizer shafts rotatably mounted on said guide frame;

a pair of mating pinion gears mounted on respective ends of said pair of stabilizer shafts; and respective rack gears operatively connected to said gantry frame and cooperating with each pinion gear in each of said pair of mating pinion gears.

21. The apparatus for manufacturing a truss by pressing truss plates into prepositioned wood pieces, said apparatus comprising:

a platform for supporting the prepositioned wood pieces;

a gantry frame mounted for back and forth movement along said platform;

a roller rotatably mounted on said gantry frame for pressing the truss plates into the prepositioned wood pieces as said gantry frame moves along said platform; and lifting means positioned adjacent an end of said platform and operatively connected to said gantry frame and roller simultaneously relative to said platform for moving said gantry frame between a lowered position and an elevated position generally vertically aligned with the lowered position, said gantry frame and roller when in the elevated position facilitating removal of the truss from the end of said platform by passing the truss under said roller.

22. An apparatus for manufacturing a truss as defined in claim 21 further comprising final press means positioned downstream from said lifting means for pressing the truss plates further into the truss, and wherein said final press means comprises a pair of opposing nip rollers generally aligned with a plane defined by said platform.

23. An apparatus for manufacturing a truss as defined in claim 21 wherein said lifting means comprises at least one inflatable bag operatively connected to said gantry frame.

24. An apparatus for manufacturing a truss as defined in claim 21 further comprising at least one conveyor roll rotatably mounted to said lifting means for conveying the truss during removal thereof.

25. An apparatus for manufacturing a truss as defined in claim 21 wherein said lifting means comprises guide means operatively connected to said gantry frame for guiding same during vertical movement between the lowered position and the elevated position generally vertically aligned with the lowered position.

26. An apparatus for manufacturing a truss as defined in claim 25 wherein said guide means comprises:

a guide frame;

a pair of stabilizer shafts rotatably mounted on said guide frame;

a pair of mating pinion gears mounted on respective ends of said pair of stabilizer shafts; and respective rack gears connected to said lift frame and cooperating with each pinion gear in each of said pair of mating pinion gears.

* * * * *

UNITED STATES PATENT AND TRADEMARK OFFICE

CERTIFICATE OF CORRECTION

PATENT NO. : 5,553,375

DATED : September 10, 1996

INVENTOR(S) : Powers

It is certified that error appears in the above-indentified patent and that said Letters Patent is hereby corrected as shown below:

Column 6, line 16, "8" should be --$\theta$--.

Column 7, line 65, insert a space before "below".

Column 10, line 37, "Claim 8" should be --Claim 6--.

Signed and Sealed this

Thirty-first Day of December, 1996

*Attest:*

*Attesting Officer*

BRUCE LEHMAN

*Commissioner of Patents and Trademarks*